US010259002B1

(12) United States Patent
Kuo

(10) Patent No.: US 10,259,002 B1
(45) Date of Patent: Apr. 16, 2019

(54) SPRAY-GUN APPARATUS

(71) Applicant: GRAIN POINT ENTERPRISE LIMITED, Keelung (TW)

(72) Inventor: Chao-Ming Kuo, Keelung (TW)

(73) Assignee: GRAIN POINT ENTERPRISE LIMITED, Keelung (TW)

( * ) Notice: Subject to any disclaimer, the term of this patent is extended or adjusted under 35 U.S.C. 154(b) by 0 days.

(21) Appl. No.: 15/947,875

(22) Filed: Apr. 9, 2018

(51) Int. Cl.
*A47L 9/08* (2006.01)
*B05B 7/04* (2006.01)
*B05B 7/24* (2006.01)

(52) U.S. Cl.
CPC ..... *B05B 7/2429* (2013.01); *B05B 7/045* (2013.01); *B05B 7/2435* (2013.01); *B05B 7/2459* (2013.01); *B05B 7/2491* (2013.01); *A47L 9/08* (2013.01)

(58) Field of Classification Search
CPC ..... B05B 7/045; B05B 7/2429; B05B 7/2435; B05B 7/2459; B05B 7/2491; A47L 7/0009; A47L 7/0014; A47L 9/08
USPC ..... 15/300.1, 320–322
See application file for complete search history.

(56) References Cited

U.S. PATENT DOCUMENTS

2010/0320289 A1* 12/2010 Kuo ..... B05B 3/022 239/290
2012/0286065 A1* 11/2012 Lin ..... B05B 3/0409 239/225.1
2014/0061334 A1* 3/2014 Liao ..... B05B 3/00 239/315
2015/0266041 A1* 9/2015 Liao ..... B05B 3/06 239/373
2016/0332175 A1* 11/2016 Fu ..... B08B 3/028
2017/0120266 A1* 5/2017 Fu ..... B05B 3/16

* cited by examiner

*Primary Examiner* — Darren W Gorman
(74) *Attorney, Agent, or Firm* — Leong C. Lei

(57) ABSTRACT

A spray-gun apparatus, comprising a spray-gun handle, a spray-gun tube-body, and a connection adapter; wherein the connection adapter is connected between the spray-gun handle and the spray-gun tube-body; wherein the first conduction tube is connected with the spray-gun handle and the spray-gun tube-body to use as a gas output path, and the second conduction tube is connected with a second cover-body to use as a gas suction path. Thereby, the gas sent from the spray-gun handle is blown out through the first conduction tube of the connection adapter and the spray-gun tube-body, and the water-sucking tube set inside the spray-gun tube-body will be made to spray liquid; and the second conduction tube of the connection adapter is used to connect a gas suction apparatus, so that the gas around the second conduction tube can be sucked into through the second conduction tube of the connection adapter.

8 Claims, 5 Drawing Sheets

SPRAY-GUN APPARATUS

(a) TECHNICAL FIELD OF THE INVENTION

The present invention relates to a spray-gun apparatus, and especially relates to a spray-gun apparatus that can mixedly spray the gas and liquid out for cleaning and has the gas and dust suction capability.

(b) DESCRIPTION OF THE PRIOR ART

The conventional cleaning devices are mainly based on using the manpower to repetitively press the sprayer, and which is mainly based on the atmospheric pressure principle of air.

By pulling the rod in a pull-pushing process, the stored water is sucked into the water spray pipe, and the water is ejected from the pipe by the action of the thrust force.

However, the early sprayer of this type can only spray water in a single time during the pressing process, which will result in the frequent times of laborious pressing and often bring many inconveniences to the user.

Therefore some companies have developed a gas-liquid rotary injection device such as the Republic of China "No. M417190" patent notice, which the invention mainly discloses a gas flow tube, a spoiler tube and a liquid flow tube. The air flow tube is connected to with the spoiler tube, and the liquid flow tube is inserted into the spoiler tube and is directly extended and bent to the outside of the gas flow tube.

A high-flow gas is sprayed from the gas flow tube to the spoiler tube. At the same time, the liquid is sucked by the flow tube through the pressure difference caused by the high-flow gas, and the high-flow gas is mixed with the liquid and then sprayed out.

However, in the disclosed technology, when the high-flow gas is mixed with the liquid and sprayed out or when it is sprayed on the surface of an object to be cleaned, a large amount of mist-like water drops are generated, which will result in considerable inconvenience to the operator.

In addition, some companies in the industry developed a pneumatic cleaning gun, such as the Republic of China "No. M528216" patent notice, which the invention mainly discloses a gun-body, a nozzle cover-body and an adapter tube-body.

The gun-body includes a barrel-body section, a grip section and a fluid-nozzle section. The grip section and the fluid-nozzle section are respectively connected to opposite sides of the barrel-body section.

The nozzle cover-body is mounted on the barrel-body section of the gun-body and is surrounded with a covering space, which the fluid-nozzle section is located in the covering space of the nozzle cover-body.

The adapter tube-body is connected to the nozzle cover-body and has an gas-pumping hole connected with the covering space of the nozzle cover-body; wherein the adapter tube-body can rotate relative to the gun-body to have at least a first using position and a second using position.

In the disclosed technology, the gas-pumping hole connected with the covering space of the nozzle cover-body can suck and remove the mist-like water drops to reduce the generation of large amounts of the mist-like water drops.

However, when it is actually used, the operator must dismantle the original nozzle cover-body of the cleaning gun which has a single function and is without the gas-pumping hole at first because the nozzle cover-body is one-body formed with the gas-pumping hole.

And then, the operator can mount the nozzle cover-body having the gas-pumping hole and the gas-pumping function on the gun-body of the cleaning gun to make the cleaning gun have the gas-pumping function.

As a result, the nozzle cover-bodies with different functions are repeatedly dismantled, which will produce many inconveniences for the operator.

SUMMARY OF THE INVENTION

The spray-gun apparatus disclosed by the present invention comprises a spray-gun handle; a spray-gun tube-body; and a connection adapter; wherein the spray-gun handle is connected to an air compressor for outputting a gas, and the front end of the spray-gun tube-body is combined with a first cover-body; wherein the inside of the spray-gun tube-body is set with a rotary structure which is connected with a hollow tube-body, and one end of the hollow tube-body extends outside the spray-gun tube-body to locate inside the first cover-body; wherein the interior of the spray-gun tube-body is penetrated and set with a water-sucking tube which is also penetrated and set inside the hollow tube-body; wherein the connection adapter is connected between the spray-gun handle and the spray-gun tube-body and is connected with each other; wherein the connection adapter comprises a first conduction tube and a second conduction tube which are not connected with each other, and the first conduction tube set in the connection adapter is connected with the spray-gun handle and the spray-gun tube-body to serve as a gas output path; wherein the second cover-body is connected with the second conduction tube and is used as a gas suction path, and the second cover-body is relatively sleeved and set on the outside of the spray-gun tube-body and the first cover-body.

Thereby, the gas sent from the spray-gun handle is blown out through the first conduction tube of the connection adapter and the spray-gun tube-body, and the water-sucking tube set inside the spray-gun tube-body will be made to spray liquid; and the second conduction tube of the connection adapter is used to connect a gas suction apparatus, so that the gas around the second conduction tube can be sucked into through the second conduction tube of the connection adapter.

DETAILED DESCRIPTION OF THE PREFERRED EMBODIMENTS

The following descriptions are exemplary embodiments only, and are not intended to limit the scope, applicability or configuration of the invention in any way. Rather, the following detailed description provides a convenient illustration for implementing exemplary embodiments of the invention. Various changes to the described embodiments may be made in the function and arrangement of the elements described without departing from the scope of the invention as set forth in the appended claims.

The foregoing and other aspects, features, and utilities of the present invention will be best understood from the following detailed description of the preferred embodiments when read in conjunction with the accompanying drawings.

Figure 1:
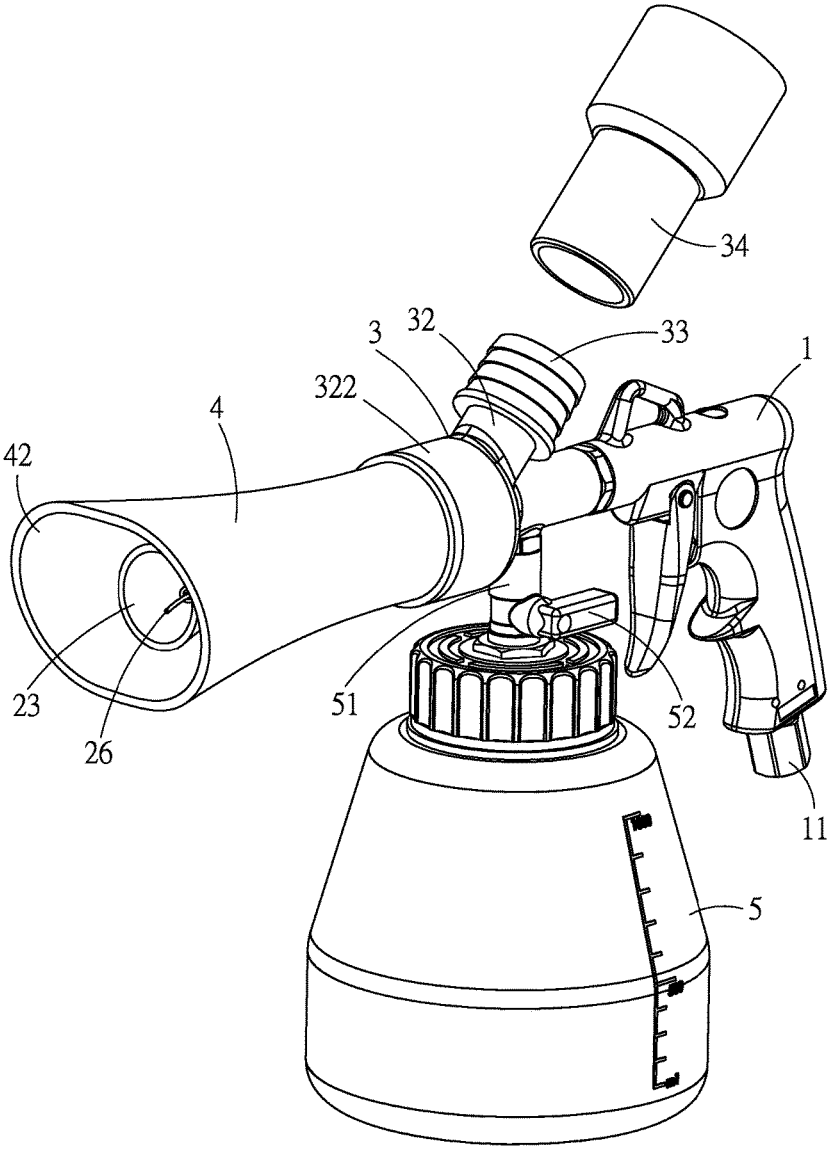
FIG. 1 is a three-dimensional assemble diagram of the spray-gun apparatus according to the present invention.
Figure 2:
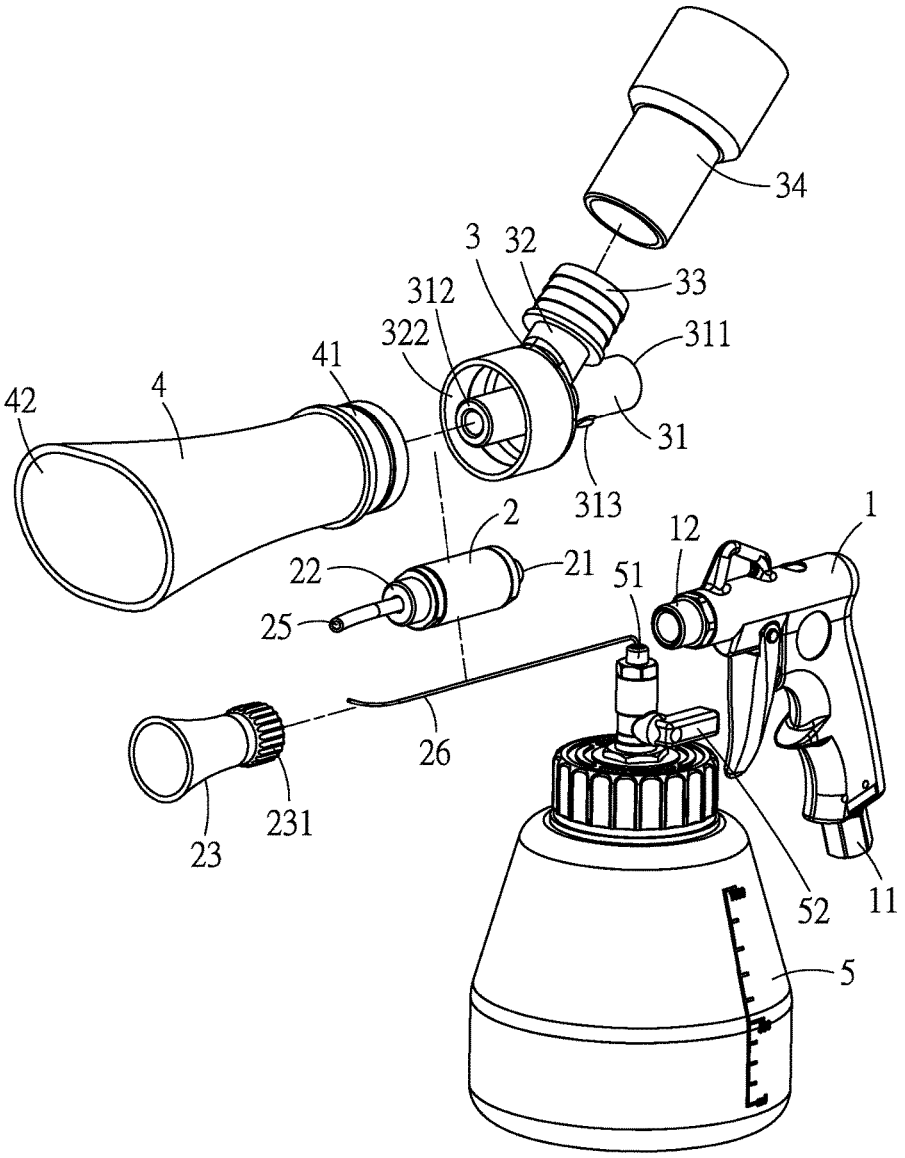
FIG. 2 is a decomposition diagram of the spray-gun apparatus according to the present invention.
Figure 3:
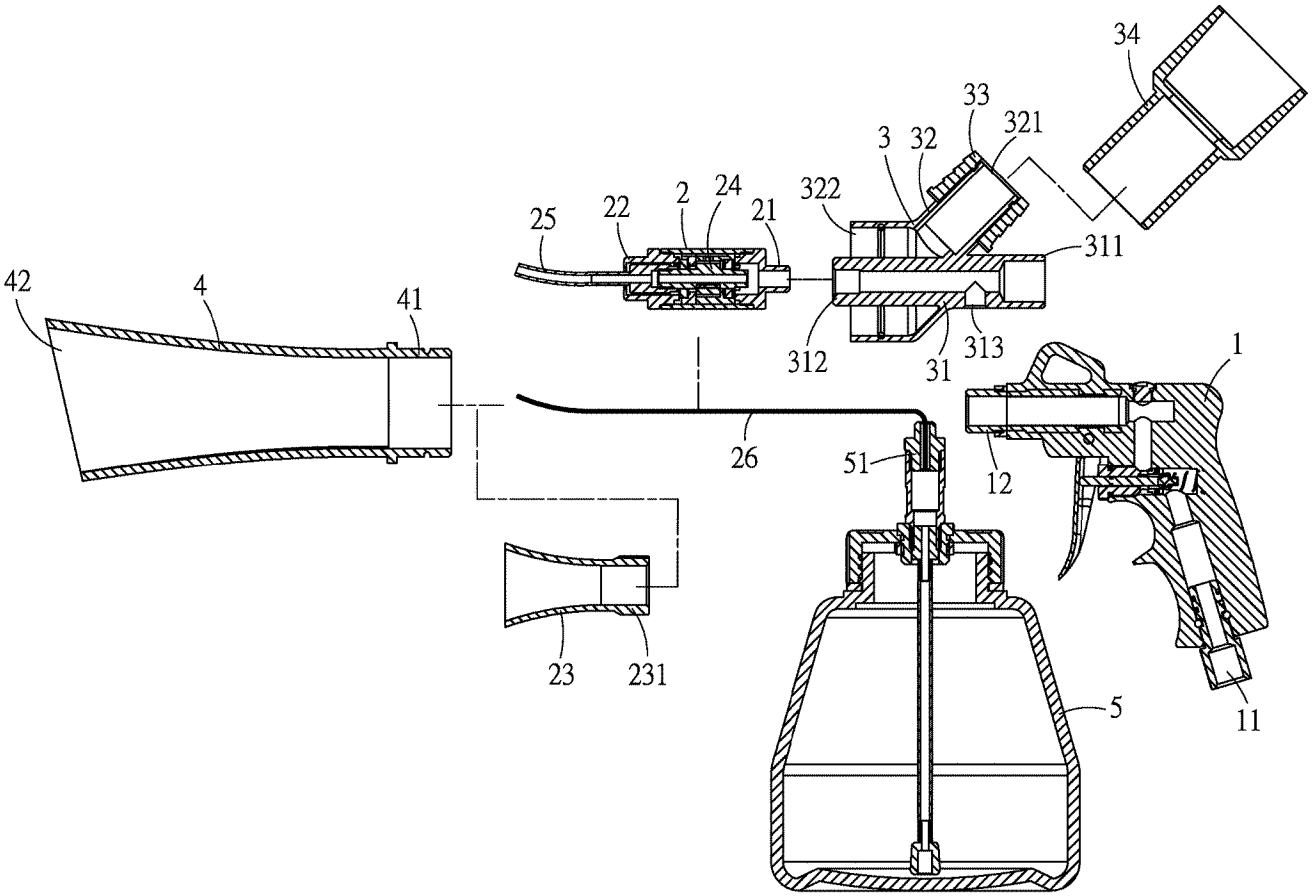
FIG. 3 is a sectional decomposition schematic diagram of the spray-gun apparatus according to the present invention.
Figure 4:
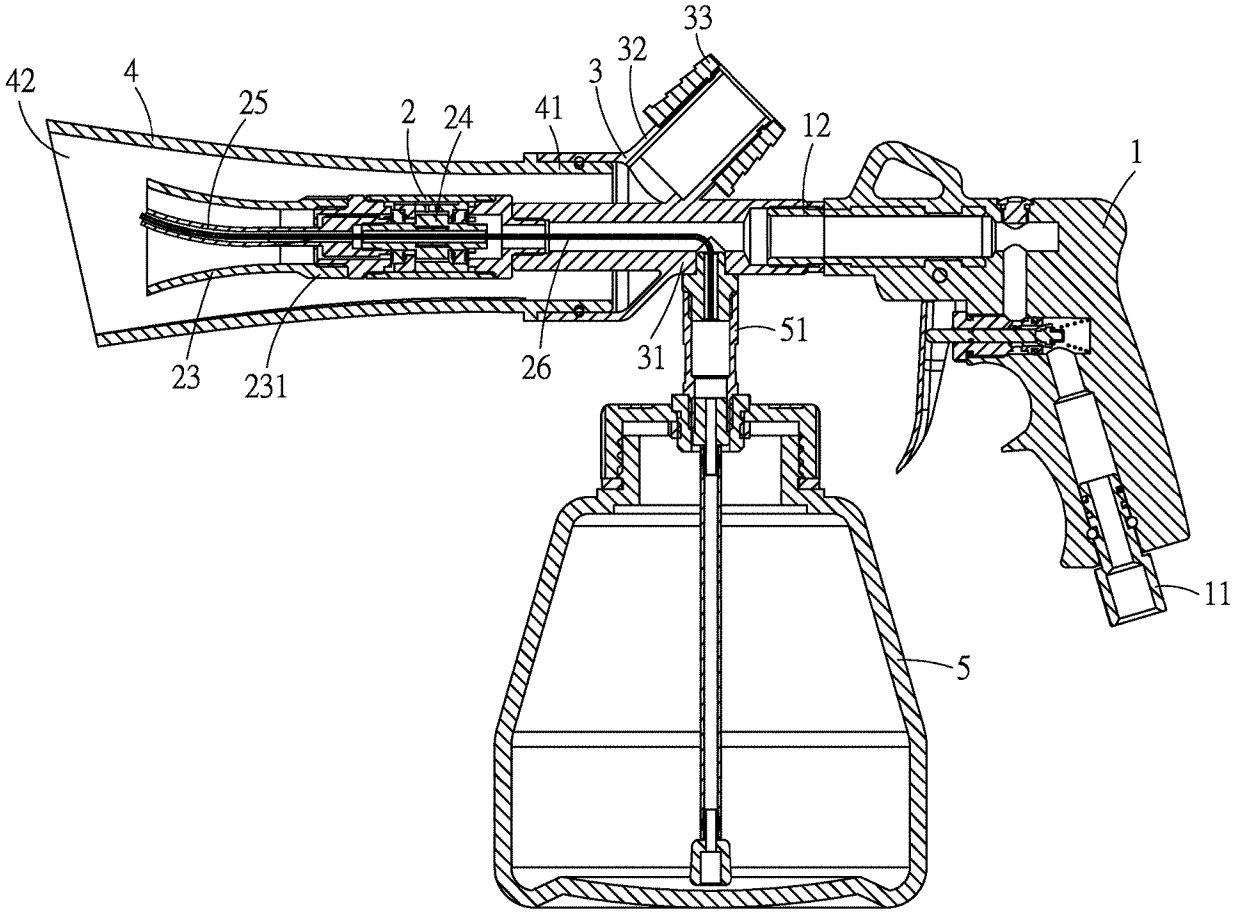
FIG. 4 is a sectional assemble schematic diagram of the spray-gun apparatus according to the present invention.
Figure 5:
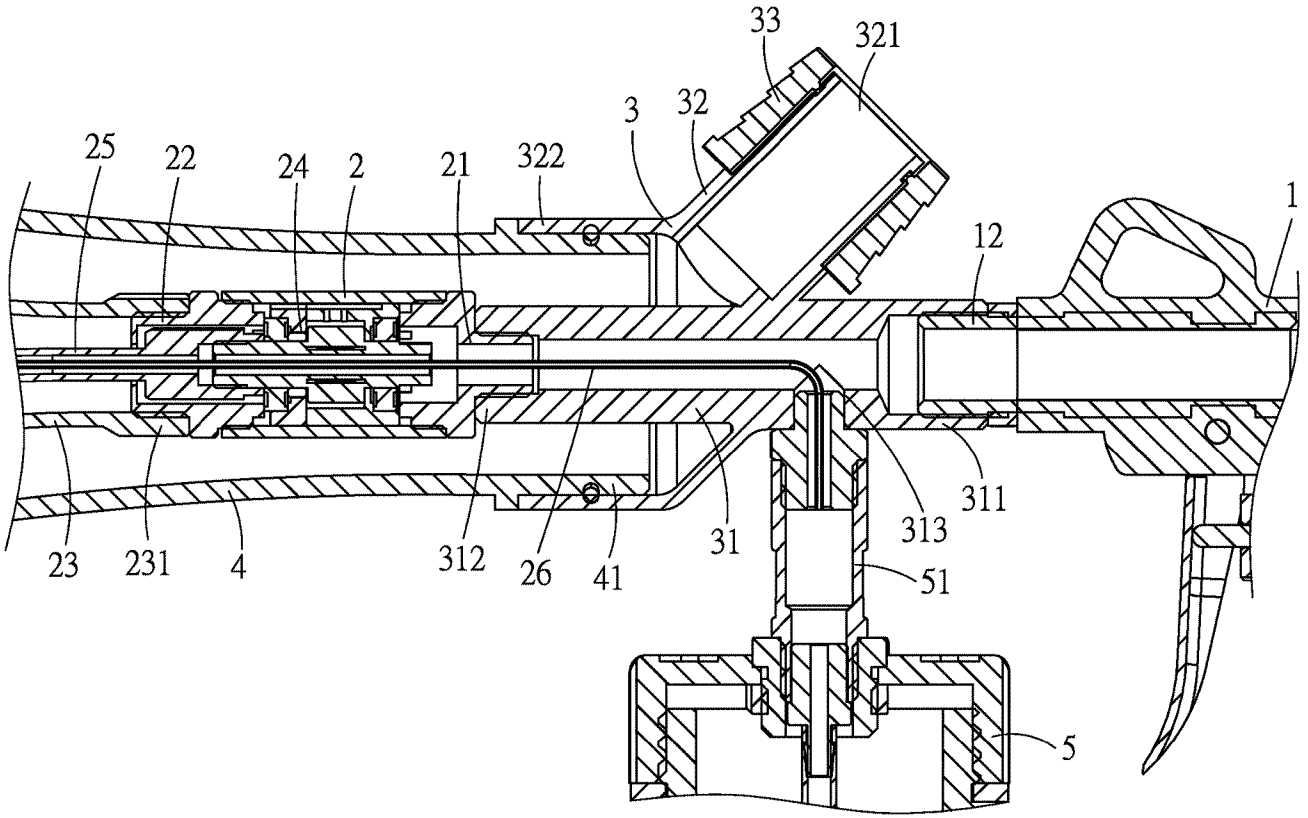
FIG. 5 is a partial-enlarged sectional assemble schematic diagram of the spray-gun apparatus according to the present invention.

Please refer to FIG. 1 to FIG. 5, the present invention discloses a spray-gun apparatus comprising a spray-gun handle 1; a spray-gun tube-body 2; a connection adapter 3, a second cover-body 4; and a liquid-solution storage bucket 5.

The spray-gun handle 1 is set with an intake end 11 and an outgassing end 12 and the intake end 11 is connected with an external air compressor, so that the output gas of the air compressor can be output through the outgassing end 12 of the spray-gun handle 1.

The spray-gun tube-body 2 is connected with the outgassing end 12 of the spray-gun handle 1. The spray-gun tube-body 2 has a first connection section 21 set at one end and a second connection section 22 set at the other end. The second connection section 22 is combined with a first cover-body 23, the first cover-body 23 has a third connection section 231 set at one end thereof and an opening, e.g. flared opening, set at the other end thereof to make the third connection section 231 of the first cover-body 23 combine with the second connection section 22. The first cover-body 23 is located at the front end position of the spray-gun tube-body 2, and the interior of the spray-gun tube-body 2 is set with a rotary structure 24 which can be rotated by the gas push. The rotary structure 24 is connected with a hollow tube-body 25, which one end of the hollow tube-body 25 disconnected with the rotary structure 24 is extended outside the spray-gun tube-body 2 and is located inside the first cover-body 23. In addition, the interior of the spray-gun tube-body 2 is penetrated and set with a water-sucking tube 26 which is penetrated the hollow tube-body 25, the rotating rotary structure 24 and the interior of the spray-gun tube-body 2; and is penetrated to the outside through the first connection section 21.

The connection adapter 3 is used to connect between the spray-gun handle 1 and the spray-gun tube-body 2 and is connected with each other.

The connection adapter 3 comprises a first conduction tube 31 and a second conduction tube 32; wherein the first conduction tube 31 has a fourth connection section 311 set at one end and a fifth connection section 312 set at the other end, and a sixth connection section 313 is set between the fourth connection section 311 and the fifth connection section 312. The fourth connection section 311 is connected with the outgassing end 12 of the spray-gun handle 1 and the fifth connection section 312 is connected with the first connection section 21 of the spray-gun tube-body 2. The spray-gun handle 1, the first conduction tube 31 and the spray-gun tube-body 2 are connected and used as a gas output and spray path; and the second conduction tube 32 of the connection adapter 3, which is a one-body form, is set outside the first conduction tube 31 and is not connected with the first conduction tube 31. The second conduction tube 32 has a seventh connection section 321 set at one end and an eighth connection section 322 set at the other end. The eighth connection section 322 and the fifth connection section 312 are oriented in the same direction and surrounded the outside of the fifth connection section 312. The eighth connection section 322 is combined with a second cover-body 4; wherein a ninth connection section 41 is set at one end and an opening section 42 is set at the other end of the second cover-body 4, and the ninth connection section 41 of the second cover-body 4 is combined with the eighth connection section 322 of the connection adapter 3. The second cover-body 4 is connected with the second conduction tube 32 and is used as a gas suction and intake path; wherein the diameter of the second cover-body 4 is larger than the diameter of the spray-gun tube-body 2 and the first cover-body 23 to make the second cover-body 4 be able to sleeve and set on the outside of the spray-gun tube-body 2 and the first cover-body 23.

The liquid-solution storage bucket 5 is set with a connection joint 51; wherein the liquid-solution storage bucket 5 is connected with the connection adapter 3 through the connection joint 51 and the sixth connection section 313 of the connection adapter 3, and the connection joint 51 is set with a regulating valve 52.

The water-sucking tube 26 of the spray-gun tube-body 2 can sequentially penetrate through the hollow tube-body 25, the rotary structure 24, the spray-gun tube-body 2, the first conduction tube 31, and penetrate out of the sixth connection section 313 of the first conduction tube 31; and then penetrate through the connection joint 51 to locate inside the liquid-solution storage bucket 5.

For example, one embodiment of the present invention is connecting the spray-gun handle 1, the first conduction tube 31 of the connection adapter 3, and the spray-gun tube-body 2 to serve as an output and spray path. When the gas is emitted from the outgassing end 12 of the spray-gun handle 1, the gas is sequentially sprayed through the first conduction tube 31 of the connection adapter 3, the spray-gun tube-body 2, and is finally sprayed out by the hollow tube-body 25; and the water-sucking tube 26 will draw the liquid inside the liquid-solution storage bucket 5 due to the Venturi effect to sprayed out. When the gas passes through the spray-gun tube-body 2, the rotary structure 24 can be rotated by the gas push, and the rotary structure 24 will drive the hollow tube-body 25 to rotate.

A rotating collar 33 can be sleeved and set on the outside of the seventh connection section 321 of the second conduction tube 32 to rotate; and the seventh connection section 321 can further be connected with a connecting tube 34. The connecting tube 34 can be sleeved and set on the rotating collar 33 and then connected to an external gas suction apparatus, e.g. a vacuum cleaner, through the connecting tube 34.

For example, another embodiment of the present invention is connecting the second cover-body 4, the second conduction tube 32 of the connection adapter 3 to serve as a gas suction and intake path. When the external gas suction apparatus connected to the connecting tube 34 is activated, a gas suction state is formed around the opening section 42 of the second cover-body 4; and the sucked gas, dust or liquid can pass through the second cover-body 4 and the second conduction tube 32 of the connection adapter 3 to be sucked into the external gas suction apparatus.

The technical characteristic of the present invention is lied in that: the first first conduction tube 31 and the second conduction tube 32 which are one-body formed and not connected with each other; the first conduction tube 31 of the connection adapter 3, the spray-gun handle 1, and the spray-gun tube-body 2 are connected and used as a gas output and spray path; and the second conduction tube 32 of the connection adapter 3 is connected with the second cover-body 4 to use as a gas suction and intake path. In this way, when the user does not need the spray-gun having the gas-pumping function, only the second cover-body 4 needs to be disassembled from the second conduction tube 32 of the connection adapter 3; and it only needs to combine the second cover-body 4 with the second conduction tube 32 of the connection adapter 3 again. Therefore, the operation of disassembling the first cover-body 23 is completely eliminated, and so as to achieve providing the user the convenient and quick change for the functions with gas-pumping or without gas-pumping.

I claim:

1. A spray-gun apparatus, which comprises:

a spray-gun handle set with an intake end and an outgassing end; and a spray-gun tube-body connected with the outgassing end of the spray-gun handle; wherein the spray-gun tube-body has a first connection section set at one end and a second connection section set at the other end, and the second connection section is combined with a first cover-body;

wherein the interior of the spray-gun tube-body is set with a rotary structure which is connected with a hollow tube-body, and one end of the hollow tube-body disconnected with the rotary structure is extended outside the spray-gun tube-body and is located inside the first cover-body;

wherein the interior of the spray-gun tube-body is penetrated and set with a water-sucking tube which is also penetrated and set inside the hollow tube-body;

a connection adapter is connected between the spray-gun handle and the spray-gun tube-body; and the connection adapter comprises a first conduction tube and a second conduction tube; wherein the first conduction tube has a fourth connection section set at one end and a fifth connection section set at the other end, and a sixth connection section is set between the fourth connection section and the fifth connection section; wherein the fourth connection section is connected with the outgassing end of the spray-gun handle and the fifth connection section is connected with the first connection section of the spray-gun tube-body; wherein the spray-gun handle, the first conduction tube and the spray-gun tube-body are connected and used as a gas output path; wherein the second conduction tube is set outside the first conduction tube and is not connected with the first conduction tube, and the second conduction tube has a seventh connection section set at one end and an eighth connection section set at the other end; wherein the eighth connection section and the fifth connection section are oriented in the same direction and the eighth connection section surrounds the outside of the fifth connection section; wherein the eighth connection section is combined with a second cover-body sleeved and set on the outside of the spray-gun tube-body and the first cover-body, and the second cover-body is connected with the second conduction tube to use as a gas suction and intake path.

2. The spray-gun apparatus according to claim 1, wherein the first cover-body has a third connection section set at one end thereof and a flared opening set at the other end thereof, and the third connection section is combined with the second connection section; wherein the first cover-body is located at the front end position of the spray-gun tube-body.

3. The spray-gun apparatus according to claim 1, wherein a rotating collar is sleeved and set on the outside of the seventh connection section of the second conduction tube to rotate, and the seventh connection section is further connected with a connecting tube wherein the connecting tube is sleeved and set on the rotating collar.

4. The spray-gun apparatus according to claim 3, wherein a ninth connection section is set at one end and an opening section is set at the other end of the second cover-body, and the ninth connection section is combined with the eighth connection section of the connection adapter; wherein the diameter of the second cover-body is larger than the diameter of the spray-gun tube-body and the first cover-body to make the second cover-body be able to sleeve and set on the outside of the spray-gun tube-body and the first cover-body.

5. The spray-gun apparatus according to claim 1, further comprises a liquid-solution storage bucket which is set with a connection joint; wherein the connection joint is connected with the sixth connection section of the connection adapter, and the connection joint is set with a regulating valve.

6. The spray-gun apparatus according to claim 5, wherein the water-sucking tube is sequentially penetrated and set through the hollow tube-body, the rotary structure, the spray-gun tube-body, the first conduction tube, and penetrated out of the sixth connection section of the first conduction tube; and then penetrated through the connection joint to locate inside the liquid-solution storage bucket.

7. The spray-gun apparatus according to claim 1, wherein the intake end of the spray-gun handle is connected with an external air compressor; when a gas is emitted from the outgassing end of the spray-gun handle, the gas is sequentially sprayed through the first conduction tube of the connection adapter, the spray-gun tube-body, and is finally sprayed out by the hollow tube-body; and when the gas passes through the spray-gun tube-body, the rotary structure is rotated by the gas push, and the rotary structure drives the hollow tube-body to rotate.

8. The spray-gun apparatus according to claim 4, wherein the connecting tube is connected with an external gas suction apparatus; when the external gas suction apparatus is activated, a gas suction state is formed around an opening section of the second cover-body, and the sucked gas is pass through the second cover-body and the second conduction tube of the connection adapter to be sucked into the external gas suction apparatus.

* * * * *